US010058222B1

(12) United States Patent
Willer

(10) Patent No.: US 10,058,222 B1
(45) Date of Patent: Aug. 28, 2018

(54) PARTICLE REMOVER FOR RECEPTACLE

(71) Applicant: Brian M. Willer, Vero Beach, FL (US)

(72) Inventor: Brian M. Willer, Vero Beach, FL (US)

( * ) Notice: Subject to any disclaimer, the term of this patent is extended or adjusted under 35 U.S.C. 154(b) by 0 days.

(21) Appl. No.: 15/398,700

(22) Filed: Jan. 4, 2017

(51) Int. Cl.
*A47L 5/38* (2006.01)
*A47L 7/00* (2006.01)

(52) U.S. Cl.
CPC ..... *A47L 7/0047* (2013.01)

(58) Field of Classification Search
CPC .... A47L 7/0047; A47L 7/0038; A47L 7/0028; A47L 7/0042; A47L 5/38; D01H 11/005
See application file for complete search history.

(56) References Cited

U.S. PATENT DOCUMENTS 4,162,149 A 7/1979 Mekelburg
4,360,947 A 11/1982 DeCosa et al.
4,443,235 A 4/1984 Brenholt et al.
4,704,764 A * 11/1987 Metelko, Jr. ..... A47L 7/0071 126/242
3,058,560 A 5/2000 Gab et al.
6,210,457 B1 4/2001 Siemers
6,221,135 B1 4/2001 Wirth, Jr. et al.
6,532,618 B2 * 3/2003 Koch ..... A47L 23/263 15/308
6,875,248 B1 4/2005 Shelton et al.
6,898,821 B1 * 5/2005 Bisbee ..... A47L 7/0071 15/347
6,928,691 B2 8/2005 Freeman
2011/0073599 A1 3/2011 Nieves

* cited by examiner

*Primary Examiner* — Dung Van Nguyen
(74) *Attorney, Agent, or Firm* — H. John Rizvi; Gold & Rizvi, P.A.

(57) ABSTRACT

A particle remover for selectively augmenting a receptacle is provided. The particle remover has a body which may be removably attachable to the receptacle. The body of the particle remover includes a number of particle removing apertures that are fluidly connected to a suction source. The particle removing apertures may be in fluid communication with one or more channels defined within the body. The suction source creates a negative pressure to suck particles from an exterior of the body through the particle removing apertures. The body of the particle remover is adjustable along one or more dimensions.

18 Claims, 14 Drawing Sheets

PARTICLE REMOVER FOR RECEPTACLE

FIELD OF THE INVENTION

The present invention relates generally to vacuum devices, and more particularly, to a particle remover attachable to a receptacle.

BACKGROUND OF THE INVENTION

Open containers or receptacles such as garbage cans are used to store items therein. Sometimes, a user may desire to collect dust or dusty debris in such receptacles. Particulate matter such as dust, wood filing residue, and ash is frequently handled in the construction industry, and it is difficult to localize such particles in a receptacle since these particles have a tendency to spread from one location to another. For example, a construction worker may desire to shovel debris into a receptacle. However, shoveling dusty debris into a receptacle may cause air and dust to be displaced, subsequently causing dust to escape from or bypass the receptacle, hindering a user from completing a debris collecting task or causing the user to inhale the dust which may lead to respiratory illness. Further, receptacles holding dusty matter may require dumping into another target receptacle, which may likewise cause dust to escape into an exterior environment of the receptacles.

To remedy these issues, a vacuum nozzle of a conventional vacuum could be positioned near an opening of a receptacle while transferring debris. However, this method is inconvenient and is not effective at capturing dust from all sides of a rim of the receptacle. Further, it would be difficult and inconvenient to position and hold such a conventional nozzle for appropriately removing dust near the rim.

Accordingly, there is an established need for an improved, convenient, and effective system for removing dust from an open end of a receptacle.

SUMMARY OF THE INVENTION

Disclosed is a particle remover for augmenting a receptacle, the particle remover comprising, a body removably attachable to the receptacle, the body including one or more particle removing apertures and being connectable to a suction source that is fluidly connectable with the one or more apertures for sucking particles from an exterior of the body through the one or more apertures.

In another aspect, the suction source is fluidly connectable to the one or more apertures via a hose.

In another aspect, the body includes an outlet that is fluidly connected to the one or more particle removing apertures, the outlet being fluidly connectable with the suction source.

In another aspect, the suction source is connectable to cause particles to be sucked through the apertures in response to a negative pressure created by the suction source.

In another aspect, the one or more apertures are fluidly connected with one or more channels in the body, the one or more channels being fluidly connectable with the suction source.

In another aspect, the body is configured to selectively clip on the receptacle.

In another aspect, the body is shaped to rest on a top rim of an opening of the receptacle.

In another aspect, a perimeter of the body has a same shape as an opening rim of the receptacle.

In another aspect, the body has a perimeter and a space inside the perimeter, and includes a bridge structure that is configured to cross over the space from one point on the perimeter of the body to another point on the perimeter of the body across the space, the bridge structure including at least one particle removing aperture.

In another aspect, the body is configured to partially cover an opening of the receptacle.

In another aspect, the body is adjustable along at least one dimension.

In another aspect, the body is adjustable along at least two dimensions, the two dimensions being perpendicular to one another.

In another aspect, the body includes at least one displaceable portion, the displaceable portion being selectively slidable over an adjustment arm of the body to selectively change a shape of a perimeter of the body.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Disclosed is a particle remover that is configured to removably attach to a rim of a receptacle, the particle remover including one or more apertures that are configured to fluidly communicate with a suction source for removing or sucking particles from an exterior vicinity of the apertures near the rim or in a space defined by the rim, through one or more channels of the particle remover. The particle remover may be adjustable along one or more dimensions allowing the particle remover to be attachable to different shapes and sizes of receptacle rims.

Figure 1:
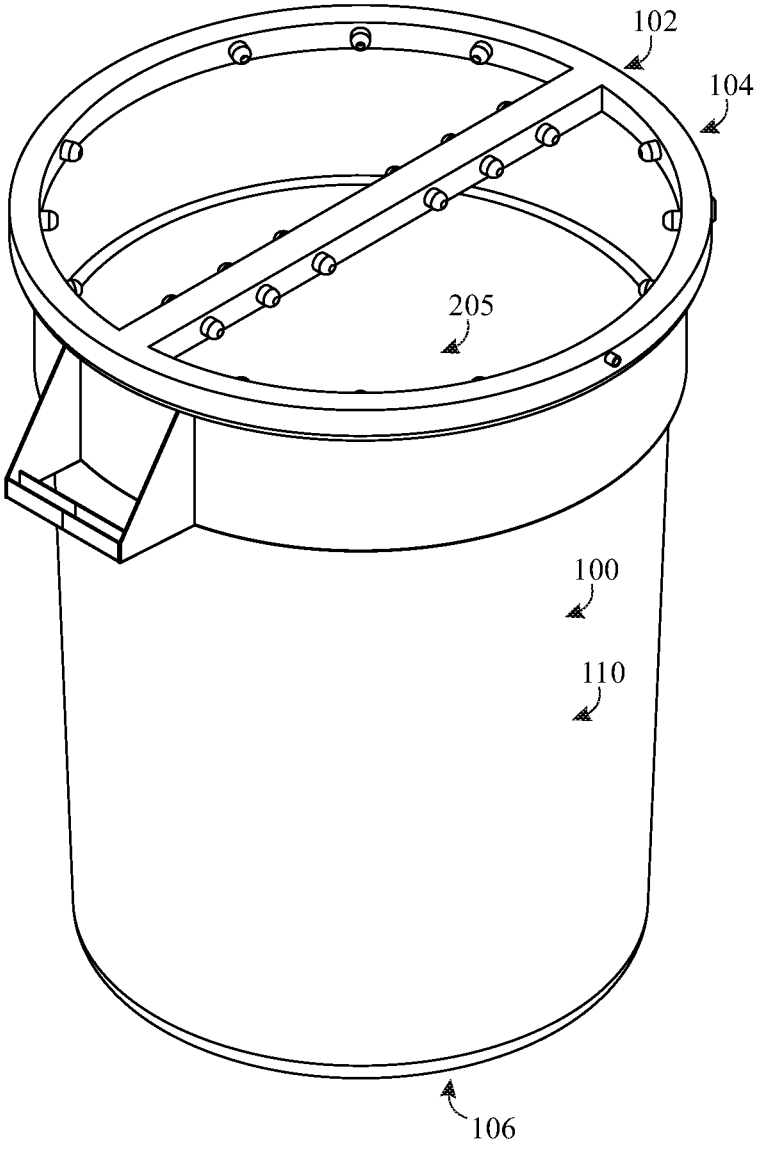
FIG. 1 presents a top perspective view of a first embodiment of a particle remover supported on a receptacle, in accordance with aspects of the present disclosure.
Figure 7:
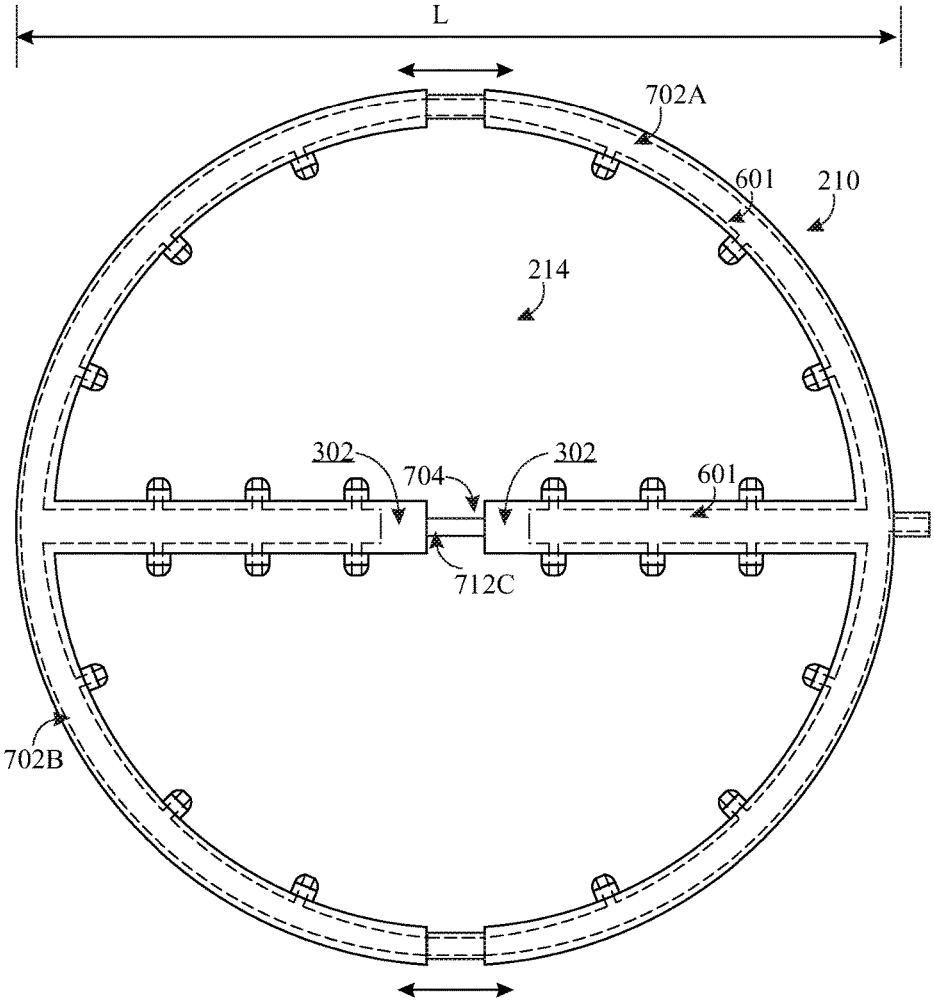
FIG. 7 presents a top view of the first embodiment of the particle remover showing adjustability of the particle remover along one dimension, in accordance with aspects of the present disclosure.
Figure 14:
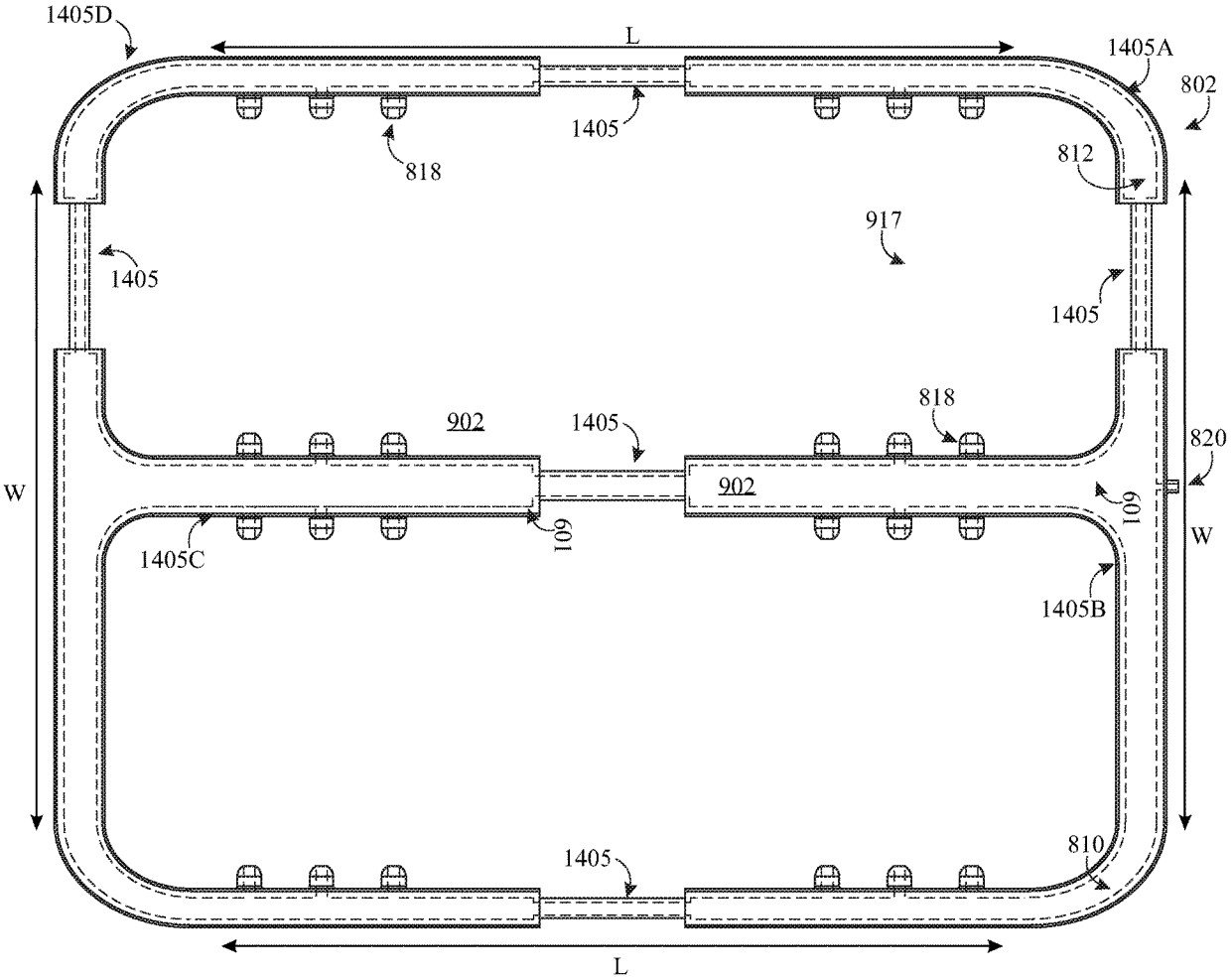
FIG. 14 presents a top view of the second embodiment of the particle remover showing adjustability of the second embodiment of the particle remover along two dimensions, in accordance with aspects of the present disclosure.

Referring to FIG. 1, an exemplary receptacle 100 is shown. Further, a particle remover 102 is shown augmenting the receptacle 100. The receptacle 100 has a top open end 104 near a top rim of the receptacle. In some examples, the receptacle 100 may be a garbage can, a paper bin, a trash bin, a recycle bin, etc. The receptacle 100 may be any open canister usable to collect items. The receptacle 100 may be a conventional, commonly found bin. The particle remover 102 may be specifically pre-shaped to fit on a rim of the receptacle. In some embodiments, the particle remover may be adjustable to fit on any size or shape of a bin rim as shown in FIGS. 7 and 14.

Figure 2:
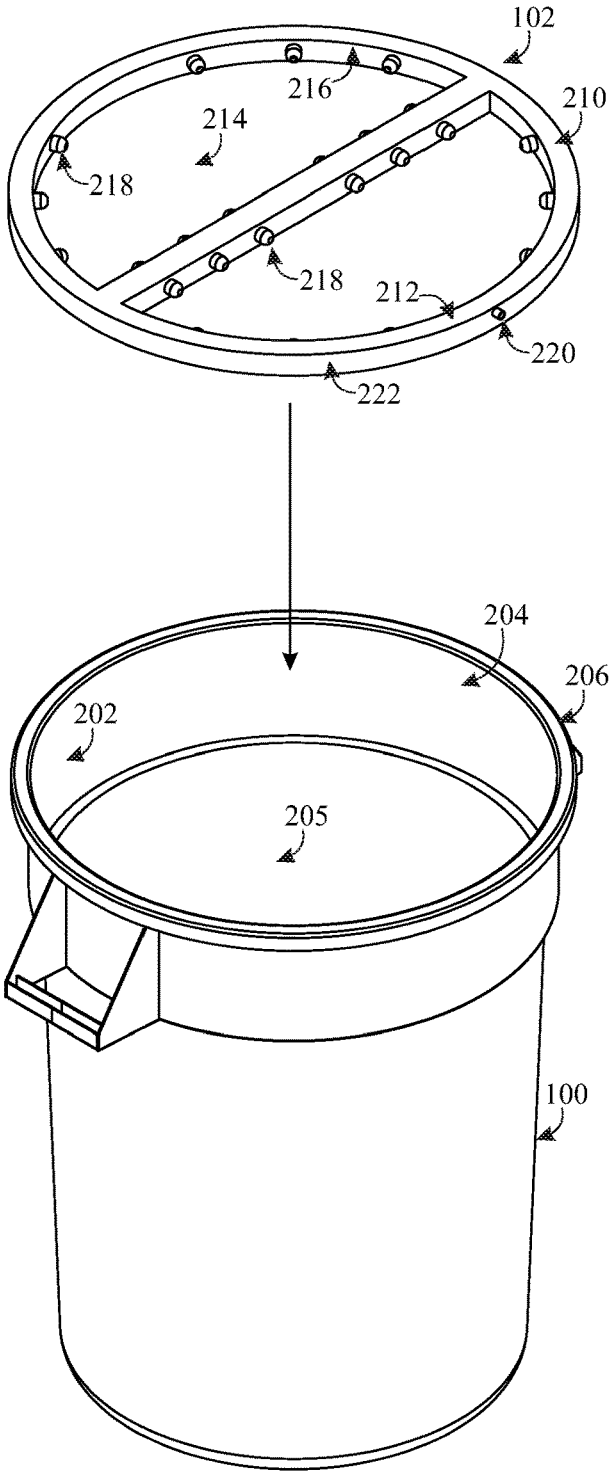
FIG. 2 presents a top perspective view of the first embodiment of the particle remover being attached to the receptacle, in accordance with aspects of the present disclosure.

Referring to FIGS. 1 and 2, the receptacle 100 may have a generally hollow cylindrical shape with an open top end and a closed bottom end that is opposite the open top end. For example, the cylindrical shape may have curved lateral walls 110 extending vertically between the top end (e.g. rim) and the bottom end, a circular closed base, and a circular open or openable top. As such, the receptacle 100 may have a closed bottom 106 formed by a bottom surface, and a top open end 104 that defines an opening 202. As shown in FIGS. 8-14, the receptacle may have a rectangular prism shape (and a rectangular rim) and may have flat lateral walls.

As shown in FIG. 2, the top open end 104 of the receptacle 100 defines an opening 202 allowing access to interior surface 204 and an internal space 205 of the receptacle 100. The interior surface 204 of the receptacle 100 may be defined by the base and walls of the receptacle and can be used to store and collect items such as paper, waste, and other materials of varying sizes. The interior surface 204 may define the internal space 205 of the receptacle. The opening 202 may be defined by a rim of the receptacle 100.

Further, the receptacle 100 includes a top rim 206. The top rim 206 may define the opening 202. The top rim 206 is located at the top open end 104 of the receptacle 100. For example, the top rim 206 may extend along a circumference or perimeter of the top opening 202 to define a shape of the opening 202. The rim 206 may have a thickness. For example, the rim 206 may have a thickness having a radial dimension with respect to a center of the opening 202.

Figure 8:
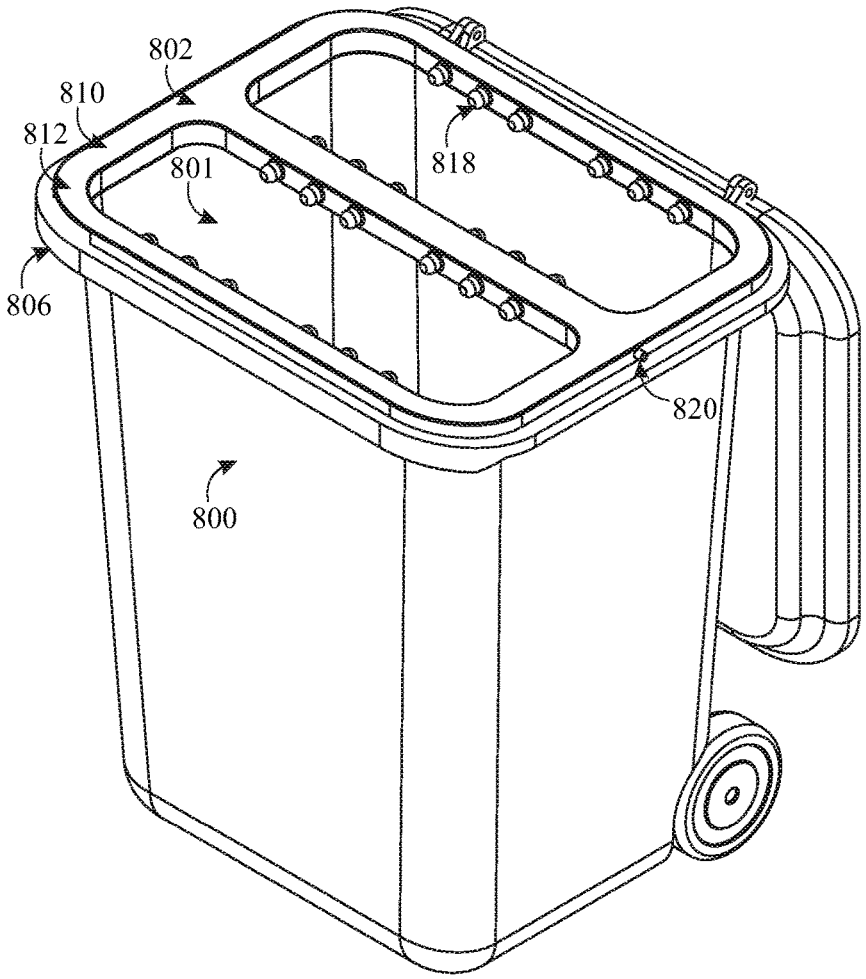
FIG. 8 presents a top perspective view of a second embodiment of the particle remover attached to a second example of a receptacle, in accordance with aspects of the present disclosure.

The receptacle 100 can be made of any suitable material such as plastic, polymer, metal or combination thereof. The receptacle and its walls may be non-porous. The shape and dimensions of the receptacle 100 may vary without departing from scope of this disclosure. For example, as seen in FIG. 8, the receptacle may have a generally rectangular prismic shape.

Figure 6:
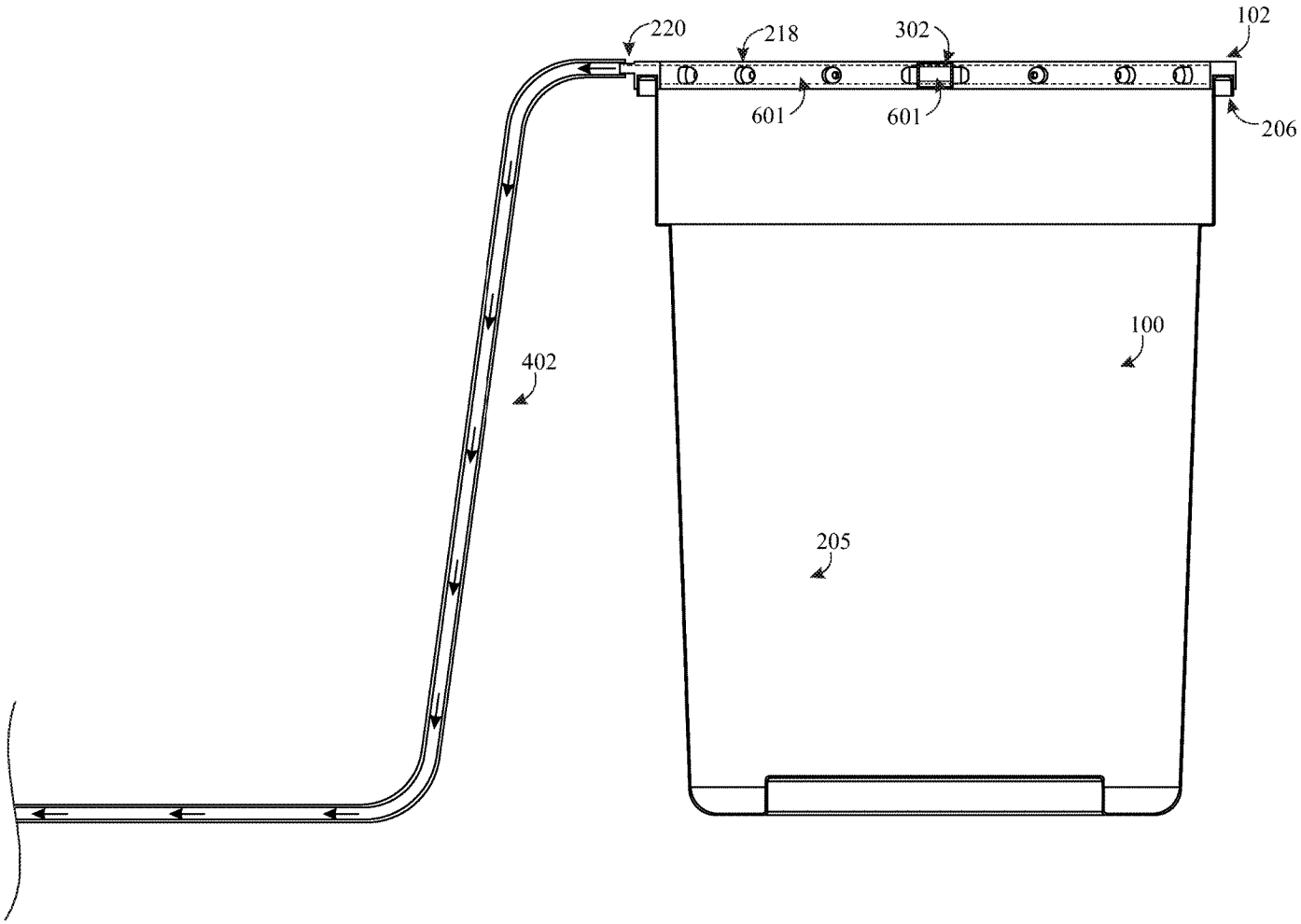
FIG. 6 presents a cross sectional elevation view of the first embodiment of the particle remover of FIG. 5 during operation, the cross section taken along sectional line 6-6 in FIG. 3, in accordance with aspects of the present disclosure.

The particle remover 102 is removably attachable to the receptacle 100 as shown in FIG. 6. The particle remover or the rim 206 may include a recess or a protrusion that fits into a respective protrusion or recess of the rim 206 or the particle remover for securing, clipping, snapping, or attaching the particle remover to the rim 206. For example, a body 210 of the particle remover 102 may have a perimeter that is configured to be supported on or removably attach to the top rim 206 of the receptacle 100. In the example shown in FIG. 8, a particle remover 802 rests within a rim 806, on a ledge or lip of the rim 806. More particularly, FIG. 14 shows the rim 806 having an internal ledge which the particle remover 802 is resting on inside the rim 806. As such, the particle remover may rest in or on an inner perimeter of a rim of the receptacle.

As shown in FIG. 6, the particle remover 102 may be clipped or snapped onto the top rim 206 of the receptacle 100. The particle remover 102 may be clipped onto the top rim 206 such that an interior, exterior, and/or bottom surface of the body 210 of the particle remover 102 conforms and snugly fits to that of the top rim 206 to mate and engage the particle remover 102 with the top rim 206 so that the particle remover 102 remains in place while matter is transferred in and out of the receptacle 100. The interior, exterior, or bottom surface of the body 210 may include a groove to circumferentially receive at least a portion of the top rim 206 in the groove for engaging, clipping, attaching, and/or securing the particle remover 102 on or to the receptacle 100. Alternatively, the interior, exterior, or top surface of the rim 206 may include a groove to circumferentially receive at least a portion of the particle remover 102 in the groove for engaging, clipping, attaching, and/or securing the particle remover 102 on or to the receptacle 100. As such, the particle remover 102 may be removably attachable to a lip or recess of the top rim 206 as shown in FIG. 6. In other words, the rim 206 and/or the body 210 may include male and female structures that are configured to mate to cause the particle remover 102 to removably attach to the receptacle 100 upon mating (e.g. see male-female connection 103 of FIG. 6). For example, the body 210 may include a groove or recess that is configured to respectively mate with a groove and/or recess of the rim 206. As another example, the rim 206 may include a groove or recess that is configured to respectively mate with a groove and/or recess of the body 210. Such grooves and/or recesses may continuously extend along a perimeter or periphery of the body 210 or respectively along the periphery of the rim 206. In some embodiments, an interior surface of the body 210 of the particle remover 102 may define a recess for locking the particle remover 102 with the top rim 206 of receptacle 100. The rim 206 may include a female recess for receiving a male structure of the body 210.

The perimeter 212 of the body 210 of the particle remover 102 may define an interior central space 214 FIG. 2 that may fluidly communicate with the top open end 104 of the receptacle 100 and/or the interior surface 204 and/or an internal space 205 of the receptacle 100, such that the interior surface 204 and/or internal space 205 of the receptacle 100 can be accessed through the space 214 while the particle remover 102 is installed on the receptacle 100. As such, the body 210 may partially cover the internal space 205 and rest on or engage the rim 206. Further, in another example the body 210 may be configured to fully leave the internal space 205 uncovered when attached to the rim 206 by only being majorly disposed at the rim 206.

The body 210 may be substantially flat or planar. For example, a vertical thickness may be substantially less than a total horizontal dimension of the body 201 (e.g. from rim-to-rim), the total horizontal dimension being from one terminal point of the body to an opposite terminal point across the space 214. As such, the body 210 may have a hollow disc shape where the solid portions of the disc engage the rim 206. For example, the particle remover may have a length L and a width W shown in FIGS. 1-14.

A radial thickness of an engaging portion of the body 210 (e.g. general areas that engage the rim 2016) may be equal to or greater than a thickness of the top rim 206 such that the top rim 206 may be completely engaged with or within the particle remover 102 while the particle remover 102 is attached to or supported on the receptacle 100. For example, a distance between an inner point of the body 210 toward the central space 214 and an outer point of the body 210 toward outer an outer perimeter 222 of the body 210 (FIG. 2) may be greater than a radial thickness of the rim 206. Further, a length between opposite terminal horizontal edges of the body 210 may be generally greater than a respective distance between opposite terminal edges of the rim 206 such that the body 210 rests on the rim 206 without falling into the internal space 205 or opening 202. In some embodiments, the particle remover 102 may be configured merely to rest on the rim 206.

As such, the body may have a shape, or perimeter, that conforms to that of the opening 202 and/or the rim 206 of the receptacle 100. Accordingly, the body 210 of the particle remover 102 may have a generally circular shape. A periphery 212 of the body 210 may be sized approximately equal to the top rim 206 of the receptacle 100.

In some embodiments, the particle remover may have a total horizontal dimension that is less than a diameter or rim-to-rim dimension of the rim 206, allowing the particle remover to be placed inside the internal space 205 below the rim 206.

To install the particle remover 102, the particle remover 102 may be guided downwards in the direction of the arrow in FIG. 2 to rest on or engage (e.g. clip onto) the top rim 206 of the receptacle 100. In some embodiments, the particle remover 102 may be configured to rest in place on the top rim 206 without requiring clipping.

A user may apply a downward force on the body 210 of the particle remover 102, causing the particle remover 102 to move downwards and engage with the top rim 206, clipping (i.e. snapping) the particle remover 102 onto the receptacle 100 as shown in FIG. 6. The particle remover 102 may be removed from the receptacle 100 when not in use. Accordingly, either the particle remover 102 may be lifted from the top rim 206 and/or a pulling force may be exerted on the particle remover 102 to pull the particle remover 102 apart from the top rim 206 of the receptacle 100 for disengaging the particle remover 102.

An inner perimeter 216 (or any appropriate portion) of the body 210 includes one or more particle removing apertures 218 (e.g. nipples) that may fluidly communicate with the opening 202 and/or the central space 214 such that particles may be sucked from a vicinity of the apertures through the apertures in response to negative pressure applied inside the body 210 (e.g. via a suction source). The particle removing apertures 218 (see FIG. 3) are shown in a spaced apart arrangement on the body 210 of the particle remover 102. The number and placement of the particle removing apertures 218 may vary and may be selected to maximize particle removing efficiency.

As shown in at least FIG. 1, a nipple or tapered extension of the body may be connected to or surround each of the particle removing apertures 218 forming a passage through the nipple or tapered extension that extends outward from the body and allows fluid communication between the opening 202 or space 214 of the receptacle 100 and an internal space of the body 210 of the particle remover 102 (e.g. channels further described below).

Figure 4:
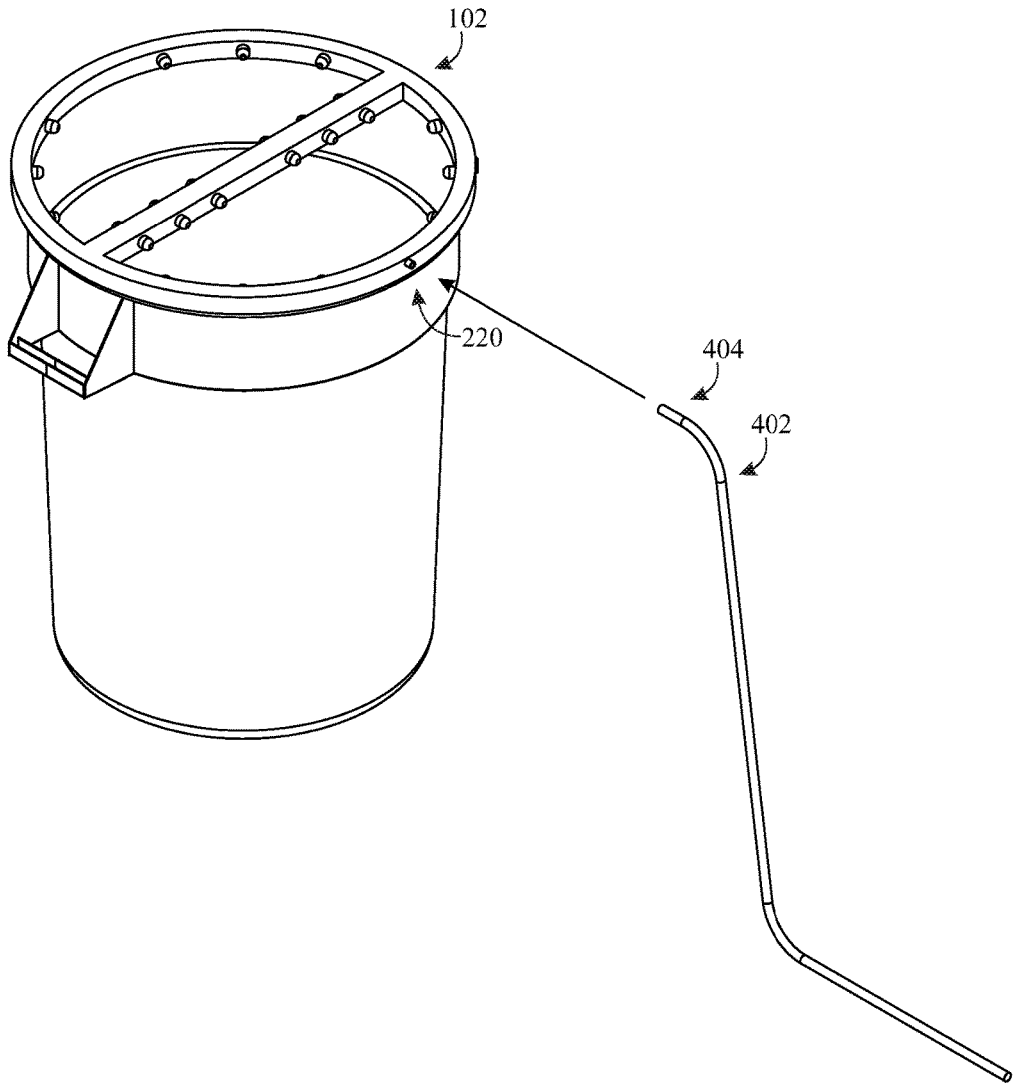
FIG. 4 presents a top perspective view of the first embodiment of the particle remover attached to the receptacle and a hose being attached to the particle remover, in accordance with aspects of the present disclosure.

The body 210 of the particle remover 102 may have hollow portions such as channels 601 (FIGS. 6, 7, 13, and 14) within the body 210 that fluidly communicate or connect with the apertures and a suction source, such as via hose 402. In some embodiments, the internal channels within the body 210 may be defined by passages formed by mating of the body 210 and the top rim 206 of the receptacle 100 (e.g. between the tip rim 206 and the body 210). In other embodiments, the channels may be completely defined within the body 210 itself. These channels run through the body 210, providing fluid communication between the particle removing apertures 218 and the space 214 of the body 210 such that air may flow through the apertures 218 and through the channels. An outlet 220 is provided on an outer perimeter 222 of the body 210. The outlet 220 is in fluid communication with the internal channels of the body 210. Referring to FIGS. 2 and 4, the outlet 220 may project outwards from the body 210, such that the outlet 220 can be received into or connected to a suction source (not shown) via a hose 402 (see FIG. 4). The outlet 220 may have a bore or may define a space such that the outlet, the internal channels of the body, and the apertures 218 are fluidly connected for sucking and/or removing particles at a top opening of the receptacle 100. As such, air may flow through the apertures, through the channels, and through the outlet due to an external negative pressure in fluid connection with the internal channels. The outlet 220 may be fluidly connected to a space or channel inside the hose 402, and the space inside the hose 402 may be fluidly connected to a vacuum or suction source such that the suction source may generate a negative pressure to cause air to be sucked into the apertures 218 from a vicinity of the apertures, through the internal channels of the body, through the outlet 220, and/or through the hose. As such, an air-tight fluid connection may be established between the suction source and the apertures for vacuuming dust through the apertures.

Figure 3:
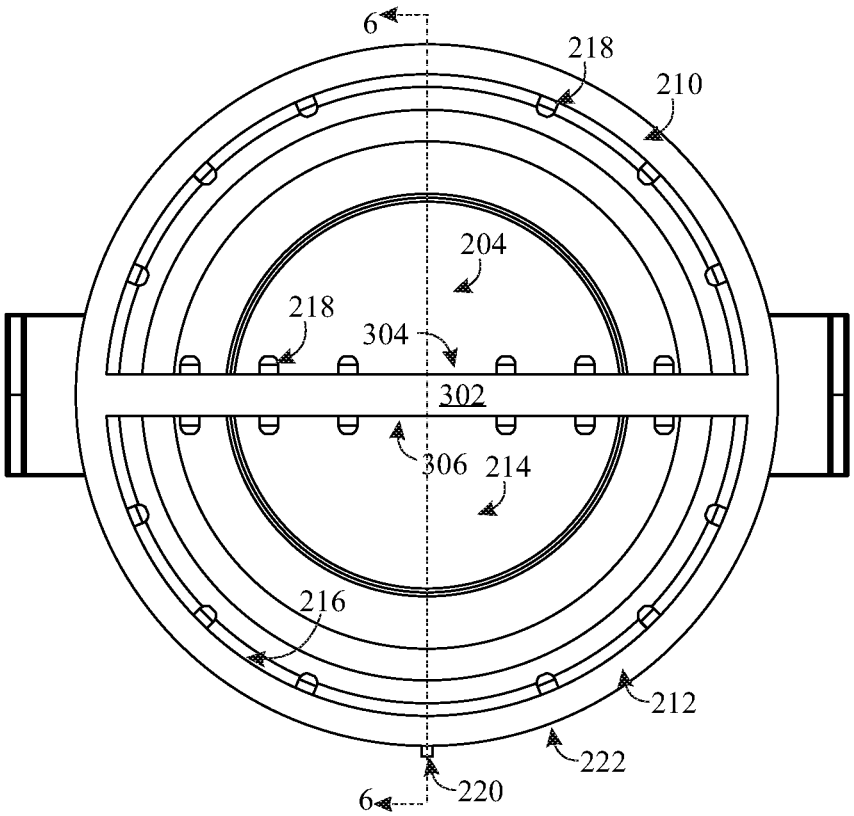
FIG. 3 presents a top view of the first embodiment of the particle remover attached to the receptacle, in accordance with aspects of the present disclosure.

As shown in FIG. 3, and as mentioned above, the body 210 of the particle remover 102 defines space 214 horizontally between the perimeter 212 of the body 210. The particle remover 102 may additionally or optionally include a bridge 302 that spans across the space 214, such that the bridge 302 is connected to perimeter 212 of the body 210 at one point, extends across the space 214 and is also connected to the body 210 at another point on the perimeter 212, across the space. The bridge 302 may provide structural rigidity to the particle remover 102 and may increase a vacuuming efficiency and effectiveness at the space 214 for vacuuming particles near the opening 202, since apertures 218 may be disposed on the bridge 302 to increase an effective number of apertures in fluid connection with the space 214. As such, the particle remover 102 may partially cover the opening 202 of the receptacle 100 when attached to the receptacle 100. It is to be understood that although one bridge 302 is shown in FIGS. 1-7, two or more bridges may be included in the body 210. For example, such multiple bridges may connect to one another or extend parallel to one another across the space 214.

The bridge 302 may also have a channel 601 as shown in FIG. 6 that is in communication with channels defined within the perimeter 212 of the body 210. One or more particle removing apertures 218 are present on any one or both side surfaces 304, 306 of the bridge 302. In the accompanying figures, six particle removing apertures 218 are provided on each side (lateral) surface 304, 306 of the bridge 302. The nipples or tapered extensions may be connected to the particle removing apertures 218. Similar to the particle removing apertures 218 on the periphery 212, the particle removing apertures 218 on the bridge 302 may fluidly communicate with the opening 202 (or a vicinity of the opening 202) of the receptacle 100 and the channels defined within body 210 of the particle remover 102. Additionally, the particle removing apertures 218 on the bridge 302 and the perimeter 212 of the body 210 may be in fluid communication with a suction source via the outlet 220 (see FIG. 2).

The particle remover 102 may be made of any suitable material including, for example, a polymer, a plastic, etc. Except the apertures, the particle remover may be generally porous of non-porous.

The particle remover 102 may be installed on the receptacle 100 to suck out particles 502 (see FIG. 5) such as, dust particles or smaller particulate matter, which may be received through the particle removing apertures 218. Dust and other particulate matter may be present while transferring debris or other dusty matter into or out of the receptacle 100 and the particle remover 102 may remove this dust or particulate matter when operated by activating a fluidly connected suction source. The operation of the particle remover 102 will now be explained in connection with FIGS. 4 to 6.

After the particle remover 102 is installed on the receptacle 100, the hose 402 which is connected to the suction source is attached to the outlet 220 in the direction of the arrow in FIG. 4. An end 404 of the hose 402 may be gripped between fingers of the user and pushed to surround the outlet 220 of the particle remover 102 to form an air tight connection, fluidly connecting a suction source, the hose, and the apertures 218. The connection is air tight such that the end 404 of the hose 402 is press fittable to the outlet 220 to ensure that no leakage may occur at the connection.

Figure 5:
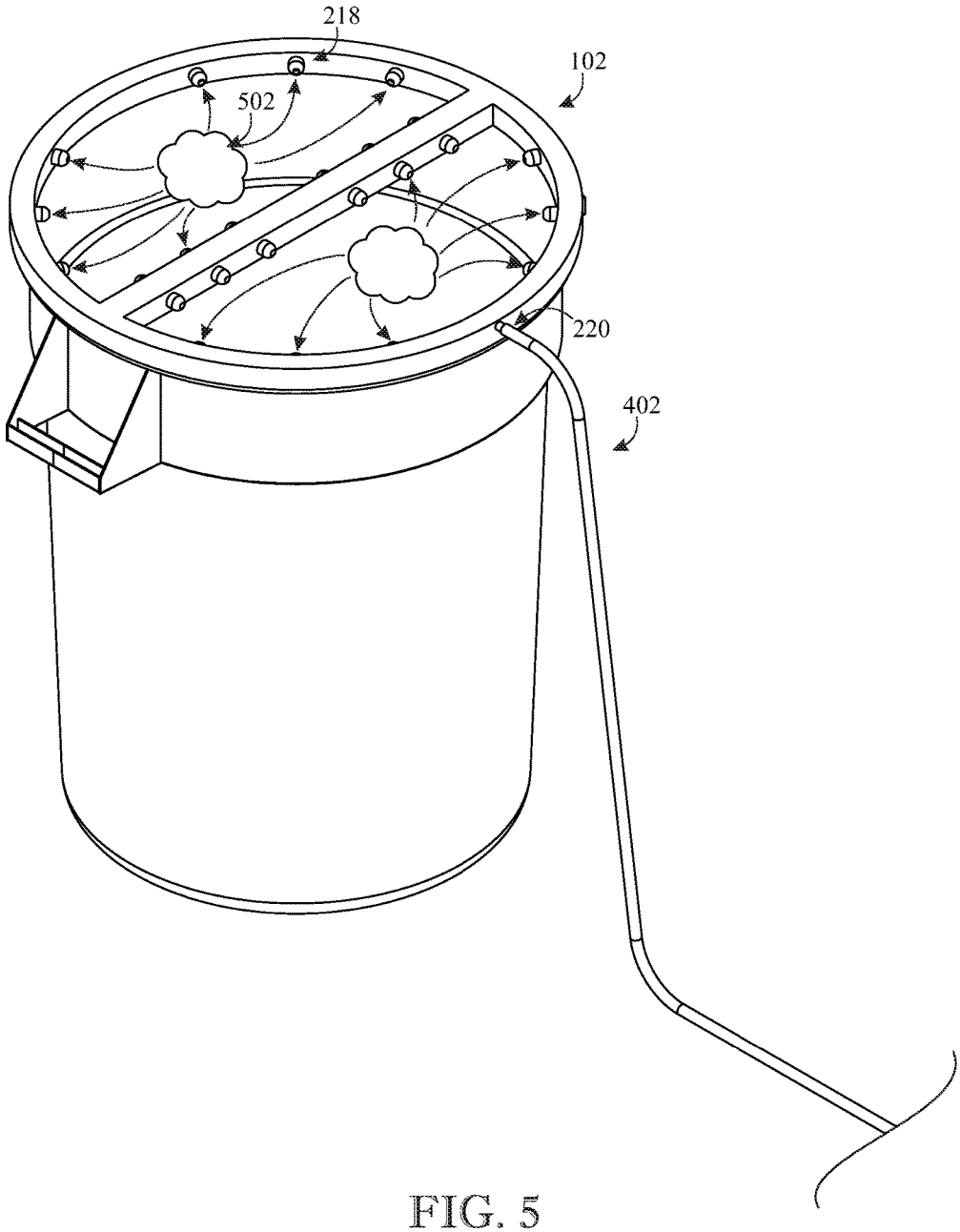
FIG. 5 presents a top perspective view of the first embodiment of the particle remover attached to the receptacle showing an exemplary operation of the particle remover, in accordance with aspects of the present disclosure.

Referring to FIG. 5, when the suction source is turned on, the particles 502 that are present proximate to the top open end 204 of the receptacle 100 and/or the space 214 experience a pulling force toward and through the apertures. The suction source creates a negative pressure (e.g. at the suction source), causing particles exterior to the body of the particle remover to be sucked into the particle removing apertures 218 in the direction of the arrows in FIG. 5.

Referring to FIG. 6, the particles 502 that are sucked into the particle removing apertures 218 of the particle remover 102 flow through the internal channels 601 of the particle remover 102 and exit the particle remover 102 through the outlet 220. The particle removing apertures 218 may be sized specifically to remove particles of a certain size, such as for removing fine particles to larger particles. As such, the apertures 218 may be configured to receive variously sized particles 502 that can be received into and flow through the particle removing apertures 218 and channels of the particle remover 102. The particles 502 may flow out of the particle remover 102 through the outlet 220 and the hose 402 in the direction of the arrows towards the suction source. The particles 502 may be collected at the suction source and appropriately disposed of.

Referring now to FIG. 7, optionally or additionally, the particle remover 102 includes one or more displaceable portions of the body 210 for adjusting the body 210 of the particle remover 102 to match variously sized receptacle rims. For example, the displaceable portions may be displaceably connected to one another, and may include at least portions 702A and 702B. In some embodiments, portion 702C may also be displaceable. The displaceable portions 702A and 702B may be displaceable with respect to one or more other displaceable portions. The displaceable portions may be semi-circular portions of the body 210 as shown in FIG. 7, or half portions of the body 210. For example, FIG. 7 shows the body 210 having two displaceable halves that are displaceable co-linearly along a longitudinal axis of the bridge 302. As such, the particle remover 102 may include at least two displaceable portions, and in some embodiments three or more displaceable portions. It is to be understood that each displaceable portion may include a dedicated outlet in communication with the channels and apertures of each displaceable portion.

As a non-limiting example, one displaceable portion (e.g. 702A) may be fixed to an adjustment arm 704 while a second displaceable portion (e.g. 702B) may be displaceably or slidably connected to, or slidable on, the adjustment arm 704. As another non-limiting example, displaceable portion 702A may be displaceably or slidably connected to adjustment arm 704, and second displaceable portion 702B may be displaceably or slidably connected to the adjustment arm 704 (e.g. where adjustment arm 704 may be considered a third displaceable portion 702C). In this way the displaceable portions may facilitate a change in the shape of the perimeter 212 of the particle remover 102 for adjusting to a rim of a receptacle. More particularly, in order to expand the particle remover 102 to fit over larger sized receptacles, the user my grip the perimeter 212 of the body 210 from opposite displaceable portions 702 and pull the body 210 of the particle remover 102 apart, separating the displaceable portions to expand the size of the particle remover 102.

In the accompanying figures, the displaceable portions are configured such that the perimeter 212 may increase by a length of the adjustment arms 704 on opposite sides of the bridge 302, increasing along a longitudinal axis of the bridge 302 and/or adjustment arms 704. This increased size of the particle remover 102 (e.g. along length L) allows the particle remover 102 to be installed on larger sized receptacles. Further, the adjustment arms 704 are constructed such that the channels formed within the body 210 on either sides of the adjustment arm 704 may be fluidly connected to the outlet 220 to allow the particles 502 to be pulled through the channels and subsequently through the outlet. For example, the channels may pass through the adjustment arms, or adjustment arms 704 may include a channel that fluidly communicates with the other channels described herein. Thus, the adjustment arms 704 facilitate in adjusting the body 210 of the particle remover 102 along an axis in the direction of the arrows of FIG. 7. In embodiments where the body of the particle remover is generally planar or flat, the body may be adjustable along a planar dimension of the body. As shown in FIG. 7, three adjustment arms are included, one mediating the bridge, and one on each opposing end of the perimeter 212.

In order to reduce a size of the particle remover 102, the user may grip the displaceable portions (e.g. on opposite sides of the perimeter 212) and push them together, causing the adjustment arms 704 to slide completely or partially into the perimeter 212 of the body 210 of the particle remover 102 or into another displaceable portion. Accordingly, adjusting the body 210 may reduce an exposed or concealed length of the adjustment arms 704 relative to the body 210 according to the expansion or contraction of the body 210. Thus, a dimension or shape of the perimeter 212 may be reduced, increased or a modified by sliding a displaceable portion of the body on a length of the adjustment arms. The location and number of the adjustment arms 704 may vary based on requirements and shape of the particle remover 102. For example, the adjustment arms may be located such that the displaceable portions of the body 210 may be symmetrically displaced.

Figure 9:
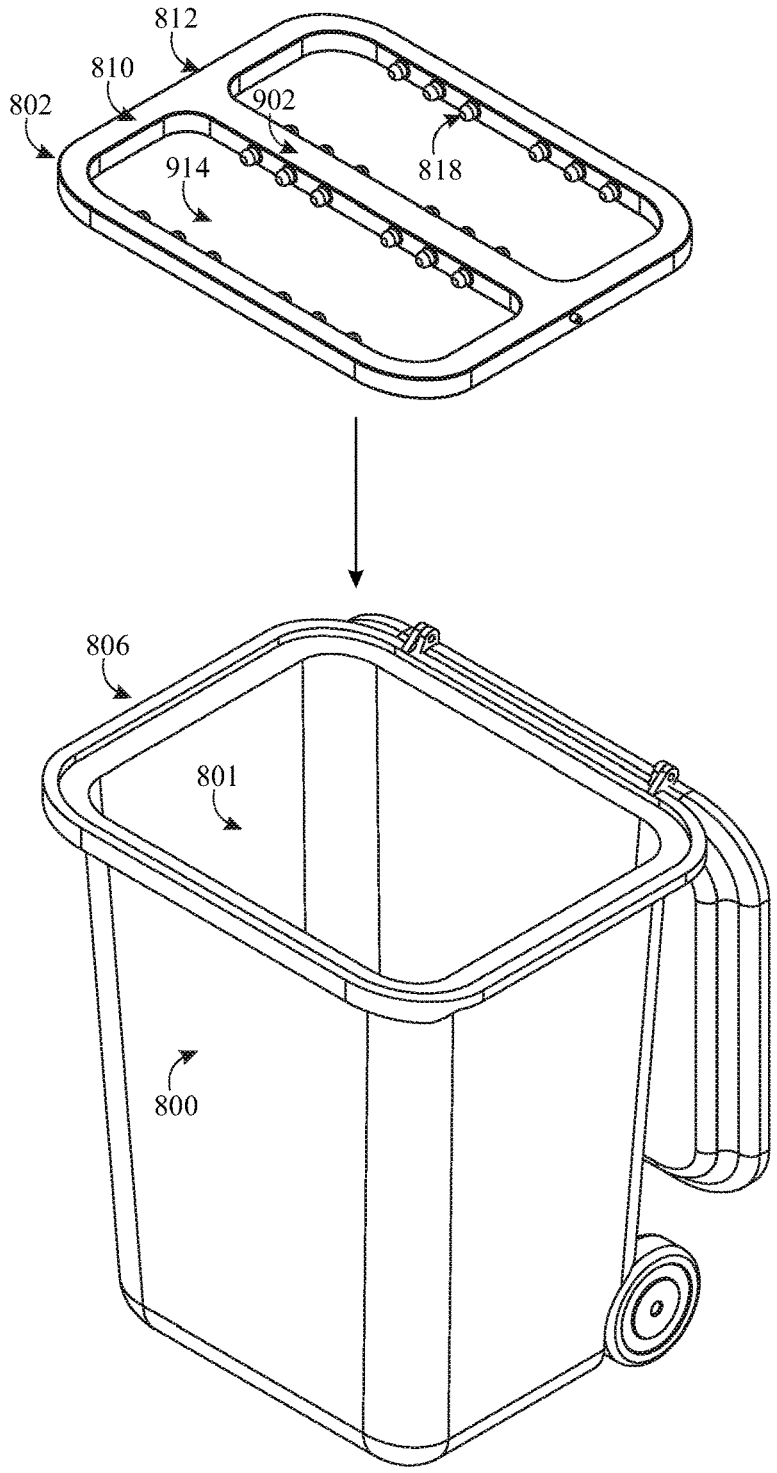
FIG. 9 presents a top perspective view of the second embodiment of the particle remover being attached to the second example of the receptacle, in accordance with aspects of the present disclosure.
Figure 10:
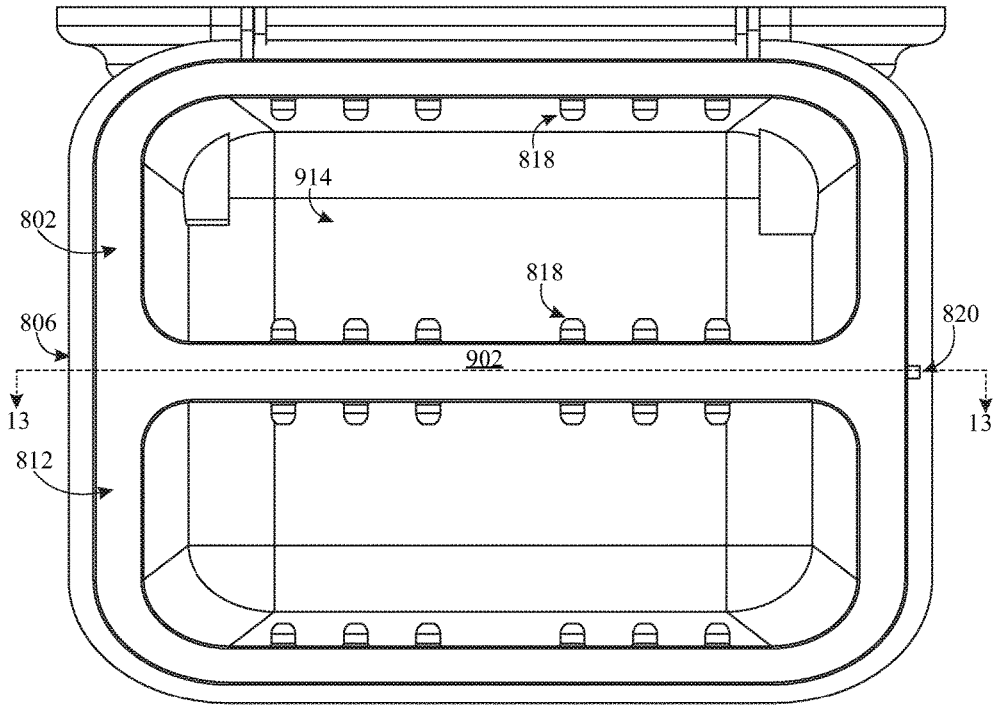
FIG. 10 presents a top view of the second embodiment of the particle remover attached to the second example of the receptacle, in accordance with aspects of the present disclosure.

FIGS. 8 to 14 illustrate another embodiment of the particle remover 802. The particle remover 802 has a similar construction and functionality as described in connection with FIGS. 1 to 7 above but instead having a different perimeter shape for being attached to a rectangular rim. The particle remover 802 has a body 810 that conforms to the shape of the opening 801 of the receptacle 800. For example, the receptacle 800 is a garbage can and has a lid that is pivotable about a hinge. The body 810 has a substantially rectangular perimeter 812 to match and fit on a rectangular rim of the receptacle 800. The body 810 includes channels 601 (FIGS. 13 and 14) defined within the body 810, the channels 601 sharing the structures and functionalities described above with respect to the channels of body 210. The body 810 also includes particle removing apertures 818 provided on perimeter 812 of the body 810. The bridge 902 extends (see FIG. 9) across the space 914 defined between a periphery of the particle remover 802 and also includes particle removing apertures 818 thereon. Referring to FIG. 10, the outlet 820 is in fluid communication with the particle removing apertures 818 via the channels 601 defined within the body 810. It is to be understood that the body 810 may appropriately share the definitions, descriptions, structures, elements, and functions of the body 210 described above with respect to FIGS. 1-7.

Figure 11:
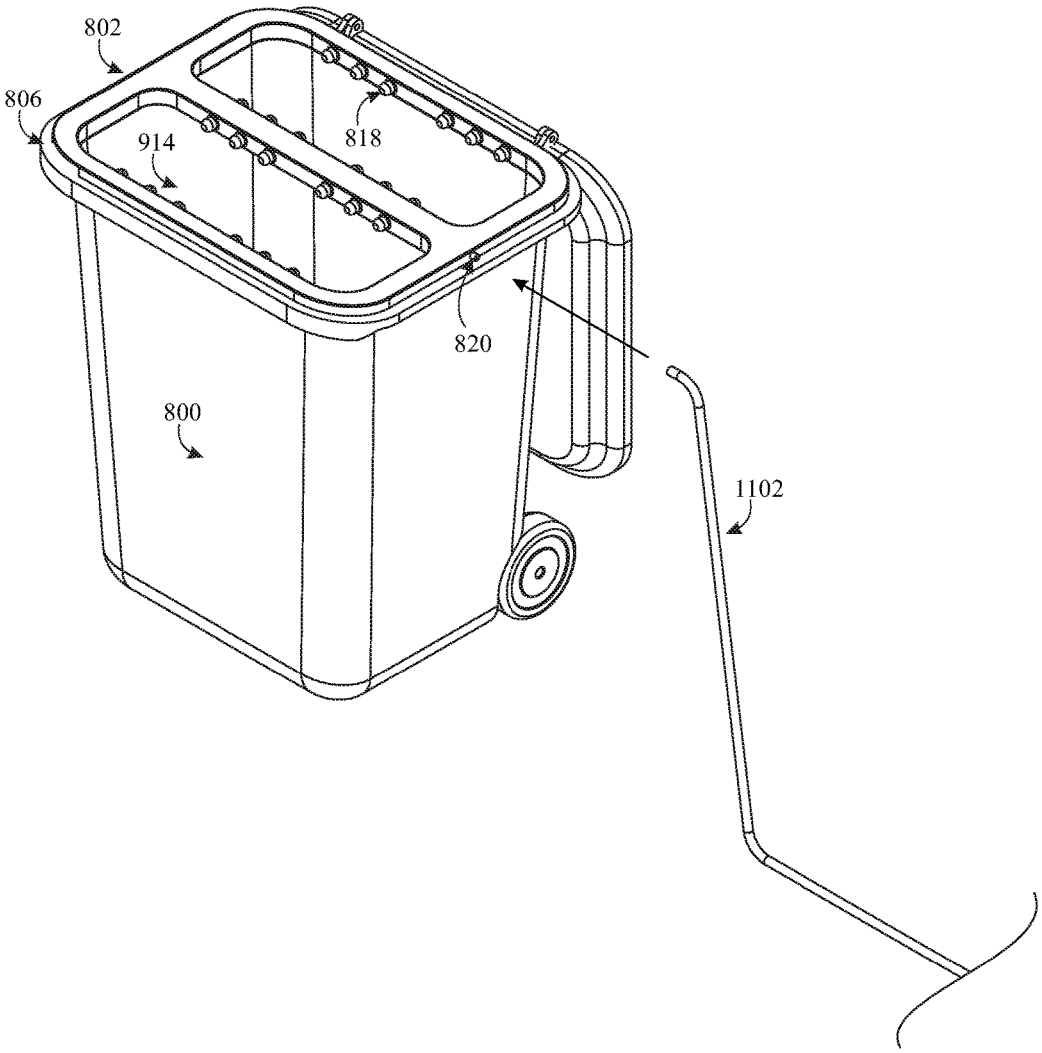
FIG. 11 presents a top perspective view of the second embodiment of the particle remover attached to the second example of the receptacle and a hose being attached to the particle remover, in accordance with aspects of the present disclosure.
Figure 12:
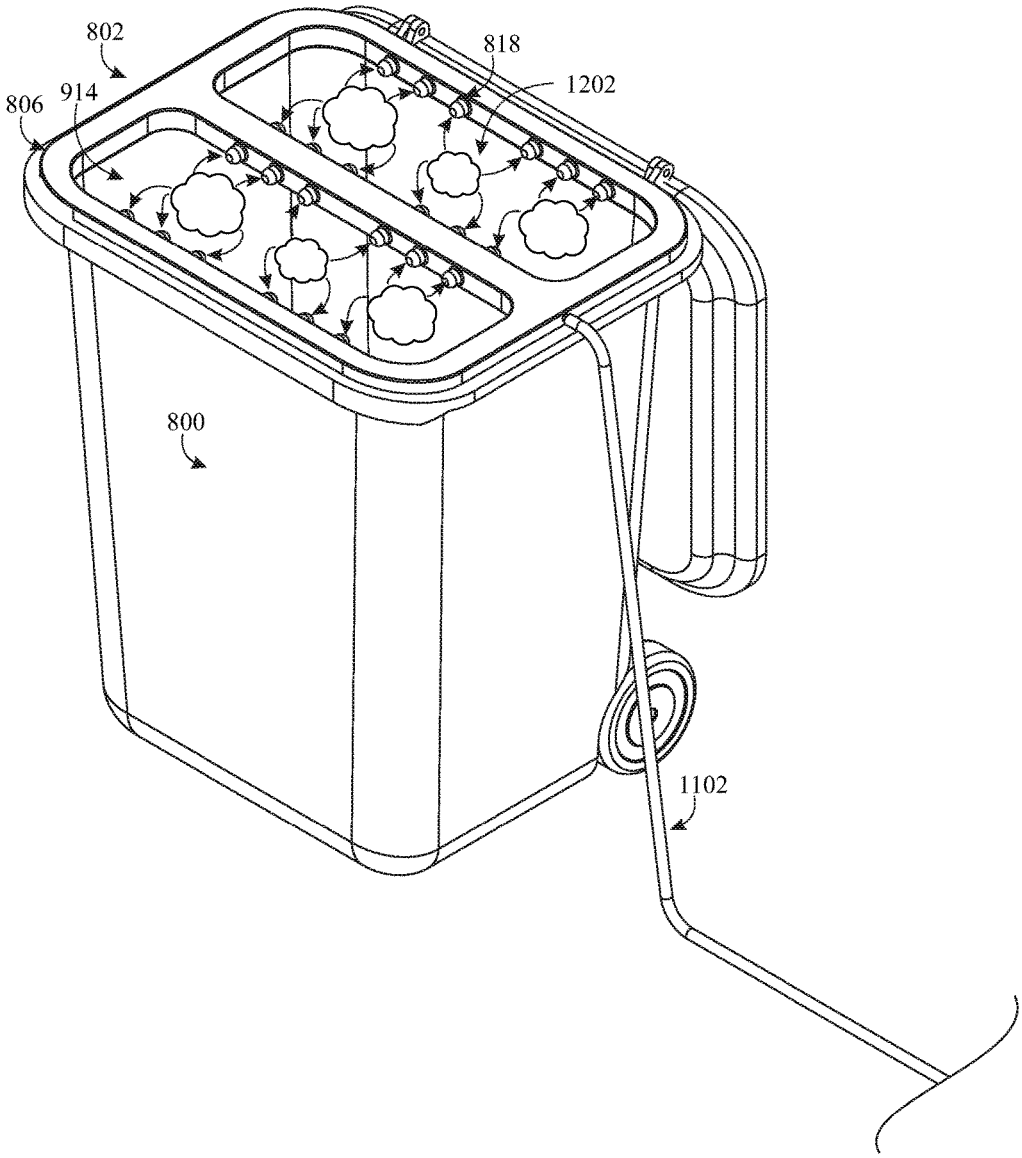
FIG. 12 presents a top perspective view of the second embodiment of the particle remover attached to the second example of the receptacle showing operation of the particle remover, in accordance with aspects of the present disclosure.
Figure 13:
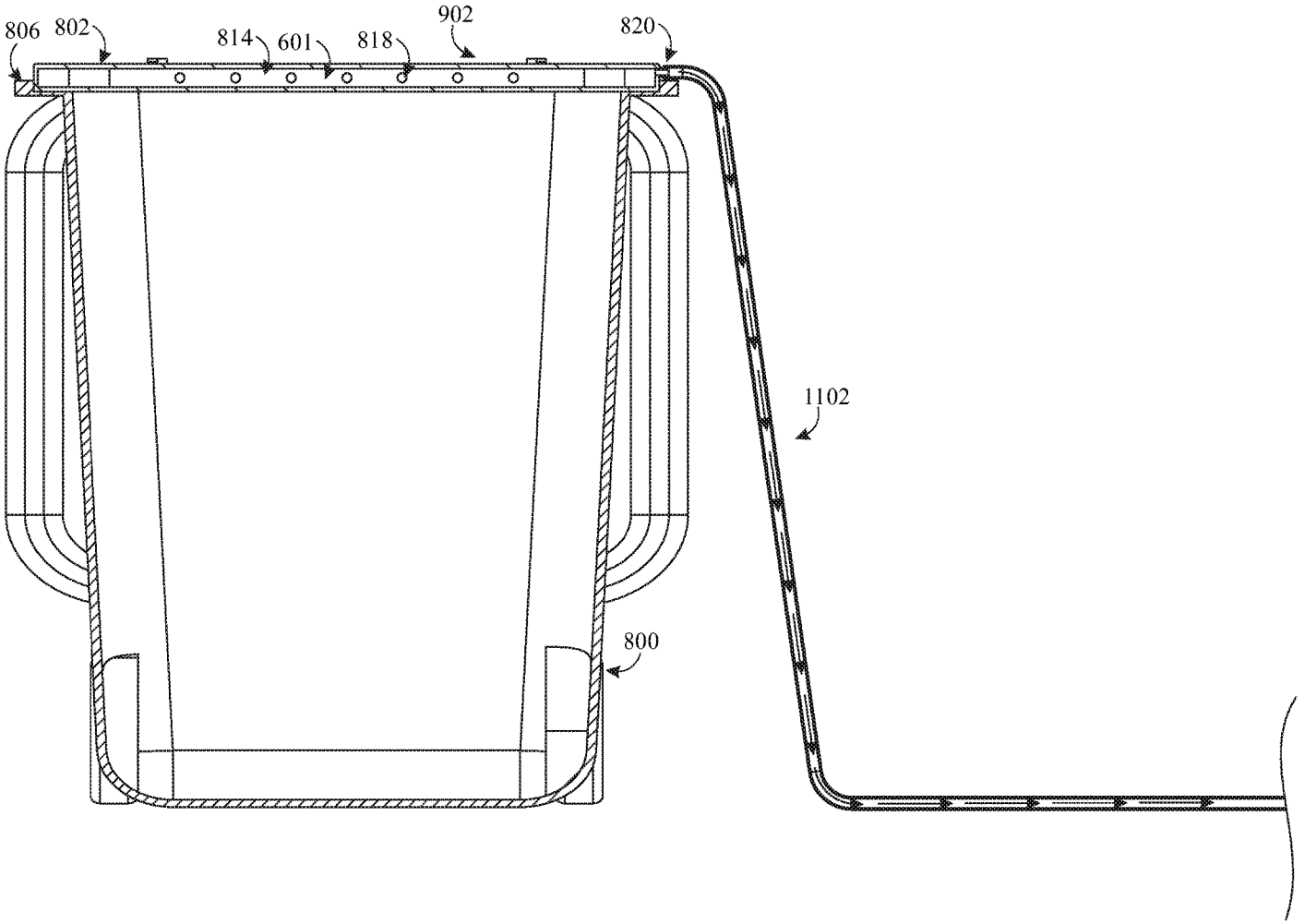
FIG. 13 presents a cross sectional elevation view of the second embodiment of the particle remover of FIG. 12 during operation, the cross section taken along sectional line 13-13 in FIG. 10, in accordance with aspects of the present disclosure.

Referring to FIG. 9, the particle remover 802 can be installed on the receptacle 800 by lowering the particle remover 802 in the direction of the arrow onto the top rim of the receptacle. The particle remover may rest on the top rim 806 of the receptacle 800. Alternatively, the particle remover 802 may engage with the top rim 806 of the receptacle 800 or clip or snap onto the top rim 806 as described above. Referring to FIG. 10, the particle removing apertures 818 communicate with the opening 801 of the receptacle 800. After installation of the particle remover 802 on the receptacle 800, as shown in FIG. 11, the hose 1102 is connected to the outlet 820 of the particle remover 802. The hose 1102 in turn is connected to the suction source. Once the suction source is turned on, as shown in FIG. 12, the particles 1202 on the exterior of the body 810 are drawn into the particle removing apertures 818 and the channels within the body 810 of the particle remover 802 in the direction of the arrows. Referring to FIG. 13, these particles 1202 are drawn towards to the suction source and travel through the hose 1102 and out of the receptacle 800 and the particle remover 802 in the direction of the arrows. The particles 1202 may then be collected at the suction source and appropriately treated or disposed of.

Referring to FIG. 14, the particle remover 802 includes four or more displaceable portions. For example, the body 810 may include first displaceable portion 1405A, second displaceable portion 1405B, third displaceable portion 1405C, and fourth displaceable portion 1405C. One or more of the diplaceable portions may be fixedly or slideably attached to one or more adjustment arms 1405, where the adjustment arms 1405 may be considered another displaceable portion. As can be seen, three of the adjustment arms 1405 are parallel to each other to allow adjustment along a length L dimension and perpendicular to two other adjustment arms 1405 that are positioned on opposite longitudinal ends of the bridge 902 for allowing adjustment along a width W dimension. Such an arrangement of the adjustment arms 1405 allows the particle remover 802 to be adjusted, that is extended (e.g. toward an extended state) or contracted (e.g. toward a contracted state), along two dimensions that are perpendicular to each other. As such, the adjustment arms 1405 may include channels so that the channels 601 of the displaceable portions may be fluidly connected to channels in the adjustment arms 1405 (e.g. air-tightly) for removing particles through the apertures 818 and through the adjustment arms and channels 601.

In one example, the user can extend or contract the displaceable portions by sliding the displaceable portions over the three adjustment arms 1405 that are parallel to the bridge 902 by pulling apart or pushing together respective displaceable portions of the perimeter 812 of the body 810, thereby increasing or decreasing a length L of the particle remover 802 respectively. In another example, the user can slidably extend or contract the displaceable portions of the body over the two perpendicular adjustment arms 1405 by pulling apart or pushing together the respective portions of the perimeter 812 of the body 810, thereby increasing or decreasing a width W of the particle remover 802 respectively. In yet another example, the user can extend or contract all five adjustment arms 1405 by pulling apart or pushing together the respective displaceable portions of the perimeter 812 of the body 810, thereby increasing or decreasing the width W and the length L of the particle remover 802 as needed to fit a target receptacle. Thus, the perimeter 812 of the body 810 can be changed based on the adjustment of the displaceable portions over the adjustment arms 1405 in the direction of the arrows of FIG. 14. The adjustment mechanism of the adjustment arms for increasing and decreasing the perimeter 812 of the body 810 is similar to that described earlier in this section.

In conclusion, particle remover 102 or 802 can be adjusted to fit on receptacles of various sizes such as receptacle 100 and 800. The particle remover 102 or 802 is a portable, lightweight, and easy solution to remove small sized particles such as dust particles near rims or openings of receptacles 100 or 800. For example, the particle remover 102 or 802 can be used in commercial and residential settings and is used for collecting dust when dumping debris into a garbage can or drum. The structure of the particle remover 102 or 802 is such that the particle remover 102 or 802 rests or clips onto the receptacle 100 or 800 and can be directly connected to a suction source, providing a solution that does not require additional extra components, saving on cost and space. The particle remover 102 and 802 provides a compact solution which is easy to install and uninstall by a user.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A particle remover for augmenting a receptacle, the particle remover comprising:

a body removably attachable to the receptacle, the body including one or more particle removing apertures and being connectable to a suction source that is fluidly connectable with the one or more apertures for sucking particles from an exterior of the body through the one or more apertures; and wherein the body has a perimeter and a space inside the perimeter, and includes a bridge structure that is configured to cross over the space from one point on the perimeter of the body to another point on the perimeter of the body across the space, the bridge structure including at least one particle removing aperture.

2. The particle remover of claim 1, wherein the suction source is fluidly connectable to the one or more apertures via a hose.

3. The particle remover of claim 1, wherein the body includes an outlet that is fluidly connected to the one or more particle removing apertures, the outlet being fluidly connectable with the suction source.

4. The particle remover of claim 1, wherein the suction source is connectable to cause particles to be sucked through the apertures in response to a negative pressure created by the suction source.

5. The particle remover of claim 1, wherein the one or more apertures are fluidly connected with one or more channels in the body, the one or more channels being fluidly connectable with the suction source.

6. The particle remover of claim 1, wherein the body is configured to selectively clip on the receptacle.

7. The particle remover of claim 1, wherein the body is shaped to rest on a top rim of an opening of the receptacle.

8. The particle remover of claim 1, wherein a perimeter of the body has a same shape as an opening rim of the receptacle.

9. The particle remover of claim 1, wherein the body is configured to partially cover an opening of the receptacle.

10. The particle remover of claim 1, wherein the body is adjustable along at least one dimension.

11. The particle remover of claim 1, wherein the body is adjustable along at least two dimensions, the two dimensions being perpendicular to one another.

12. The particle remover of claim 1, wherein the body includes at least one displaceable portion, the displaceable portion being selectively slidable over an adjustment arm of the body to selectively change a shape of a perimeter of the body.

13. A particle remover for augmenting a receptacle, the particle remover comprising:

a body removably attachable to the receptacle, the body including one or more particle removing apertures and being connectable to a suction source fluidly connectable with the one or more apertures for sucking particles from an exterior of the body through the one or more apertures;

wherein the body includes an outlet that is fluidly connected to the one or more particle removing apertures, the outlet being fluidly connectable with the suction source; and wherein the one or more apertures are fluidly connected with one or more channels in the body, the one or more channels being fluidly connectable with the suction source through the outlet; and wherein the body is adjustable along at least one dimension.

14. The particle remover of claim 13, wherein the body is configured to selectively clip on the receptacle.

15. The particle remover of claim 13, wherein a perimeter of the body has a same shape as an opening rim of the receptacle.

16. The particle remover of claim 13, wherein the body has a perimeter and a space inside the perimeter, and includes a bridge structure that is configured to cross over the space from one point on the perimeter of the body to another point on the perimeter of the body across the space, the bridge structure including at least one particle removing aperture.

17. The particle remover of claim 13, wherein the body includes at least one displaceable portion, the displaceable portion being selectively slidable over an adjustment arm of the body to selectively change a shape of a perimeter of the body.

18. A particle remover for augmenting a receptacle, the particle remover comprising:

a body removably attachable to the receptacle, the body including one or more particle removing apertures and being connectable to a suction source fluidly connectable with the one or more apertures for sucking particles from an exterior of the body through the one or more apertures;

wherein the body includes an outlet that is fluidly connected to the one or more particle removing apertures, the outlet being fluidly connectable with the suction source;

wherein the one or more apertures are fluidly connected with one or more channels in the body, the one or more channels being fluidly connectable with the suction source; and wherein the body is configured to selectively clip on the receptacle; and wherein the body has a perimeter and a space inside the perimeter, and includes a bridge structure that is configured to cross over the space from one point on the perimeter of the body to another point on the perimeter of the body across the space, the bridge structure including at least one particle removing aperture.

* * * * *